US010604400B2

(12) United States Patent
Beaton et al.

(10) Patent No.: US 10,604,400 B2
(45) Date of Patent: Mar. 31, 2020

(54) LIQUID BAG PRODUCT CASE

(71) Applicant: A.C. Dispensing Equipment Inc., Lower Sackville (CA)

(72) Inventors: Debra Beaton, Brookfield (CA); Brian Gay, Enfield (CA); Derek Cole, Lower Sackville (CA); Kyle Williston, Dartmouth (CA)

(73) Assignee: A.C. Dispensing Equipment Inc., Lower Sackville (CA)

( * ) Notice: Subject to any disclaimer, the term of this patent is extended or adjusted under 35 U.S.C. 154(b) by 0 days.

(21) Appl. No.: 16/003,539

(22) Filed: Jun. 8, 2018

(65) Prior Publication Data

US 2019/0375626 A1 Dec. 12, 2019

(51) Int. Cl.

| | |
|---|---|
| ***B65D 3/00*** | (2006.01) |
| ***B67D 3/00*** | (2006.01) |
| ***B65D 25/30*** | (2006.01) |
| ***B65D 25/06*** | (2006.01) |

(52) U.S. Cl.

CPC ..... *B67D 3/0083* (2013.01); *B65D 25/06* (2013.01); *B65D 25/30* (2013.01)

(58) Field of Classification Search

CPC ..... B67D 3/00–0083; B67D 3/0087; B67D 3/009; B67D 3/0093; B67D 3/0096; B67D 3/02; B67D 3/04; B67D 3/041; B67D 3/042; B67D 3/043; B67D 3/044; B67D 3/045; B67D 3/047; B67D 3/048; B65D 25/00–30

See application file for complete search history.

(56) References Cited

U.S. PATENT DOCUMENTS

| | | | | |
|---|---|---|---|---|
| 3,940,018 A * | 2/1976 | Scholle | ..... | B65D 77/06 222/1 |
| 3,940,052 A * | 2/1976 | McHugh | ..... | B65D 25/16 383/121.1 |
| 4,122,973 A * | 10/1978 | Ahern | ..... | B05C 21/00 220/495.02 |

(Continued)

FOREIGN PATENT DOCUMENTS

| | | | |
|---|---|---|---|
| CA | 1038808 | A | 9/1978 |
| CA | 2359743 | A1 | 4/2003 |
| JP | H1149234 | A | 2/1999 |

*Primary Examiner* — Kareen K Thomas

(74) *Attorney, Agent, or Firm* — Borden Ladner Gervais LLP; Shin Hung

(57) ABSTRACT

A product case for receiving a fluid bag used in gravity based fluid dispensing systems. The product case has a floor and sidewalls that form a rectangular enclosure for the fluid bag, and a bag supporter in contact with the fluid bag. The bag supporter includes a notch formed in a top edge of one sidewall to facilitate receipt of material of the fluid bag, a slot in the one sidewall extending from a bottom of the triangular shaped notch and configured to receive and retain the material of the fluid bag, and a removable retaining wall held by support structures on a pair of the sidewalls opposing each other to divide the rectangular enclosure into a smaller enclosure. The sidewalls and the removable retaining wall constrain the fluid bag within the smaller enclosure, while the triangular shaped notch and the slot minimizes fluid bag material from covering the outlet nozzle as the fluid bag empties and provides for repeatable flow characteristics for portion control applications.

17 Claims, 6 Drawing Sheets

(56) References Cited

U.S. PATENT DOCUMENTS

| | | | | |
|---|---|---|---|---|
| 4,898,304 | A | 2/1990 | Bacon, Jr. | |
| 5,186,359 | A | 2/1993 | Brown et al. | |
| 5,649,643 | A | 7/1997 | Ridgeway | |
| 5,673,817 | A | 10/1997 | Mullen et al. | |
| D386,049 | S | 11/1997 | Steven | |
| 7,571,835 | B2 | 8/2009 | Hill et al. | |
| D606,314 | S | 12/2009 | Neilsen | |
| 8,905,267 | B2 | 12/2014 | Minard et al. | |
| 10,221,005 | B2 * | 3/2019 | James, Jr. ..... | A45C 13/02 |
| 2003/0075558 | A1 | 4/2003 | Makino et al. | |
| 2017/0015541 | A1 | 1/2017 | Vulpitta et al. | |

* cited by examiner

FIG. 5A
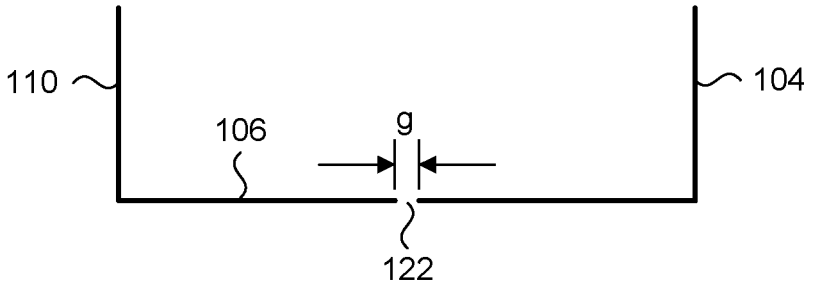
FIG. 5B
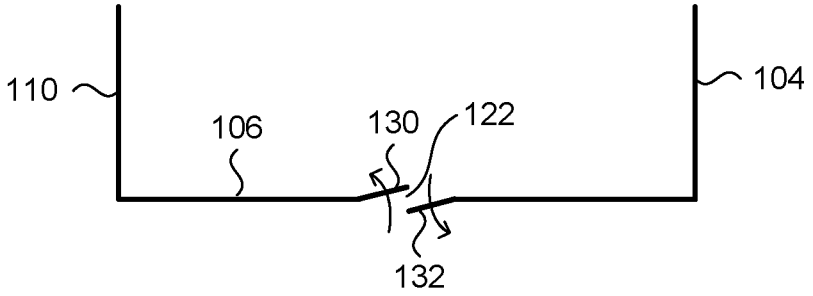
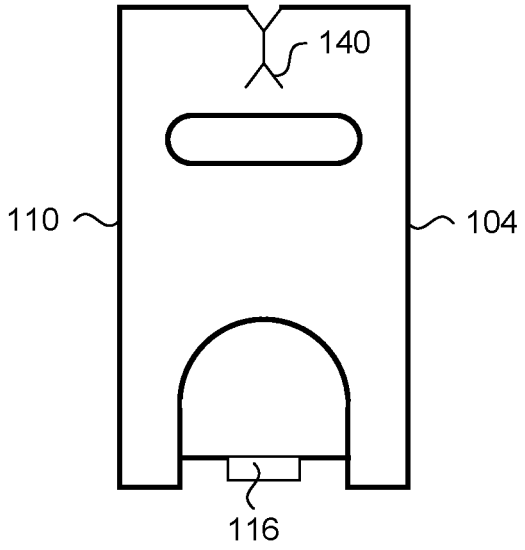
FIG. 5C

LIQUID BAG PRODUCT CASE

FIELD

The present disclosure relates generally to gravity based fluid dispensing systems. More particularly, the present disclosure relates to a product case for holding liquid bags to be used in gravity based fluid dispensing systems.

BACKGROUND

In commercial gravity aided liquid dispensing systems, such as for dispensing dairy products, large amounts of product are required on-site. For example, coffee shops and fast food restaurants serve a large number of people each day. For this reason, it is unsuitable to have a refrigerator for the server to access cartons and small milk bags typically used by the average consumer. Furthermore, refrigerators occupy a significant amount of space which is limited in a fast food restaurant location.

Refrigerated dairy dispensing machines have been developed to address this problem. One such machine is configured to receive a 10 L bag of dairy product in an enclosed refrigerated space and optimized in size to sit on a countertop. A preconfigured outlet of the bag is attached to a corresponding valve system to control dispensing of the dairy product by gravity.

Because the bag cannot structurally support itself, a product case or caddy constructed of a rigid material such as plastic, is used to hold the bag. FIGS. 1A, 1B and 10 shows different views of an example product case sized to receive and hold a 10 L bag of fluid. FIG. 1 *a* shows a front view of a product case 10 which in the present example has a handhold opening 12 and an outlet access opening 14. The floor 16 includes an opening sized and shaped to receive an outlet 18 of the liquid bag placed inside. In this particular configuration, the outlet 18 slides into the opening of the floor 16 and is latched therein to prevent it from moving. The product case 10 typically has an open top to allow for easy insertion of the liquid bag by a user.

FIG. 1B is a top view of the product case 10 shown in FIG. 1A. An outline of the liquid bag 20 is shown, and when full, would typically fill most of the floor area and press against the side walls of the product case 10. Such bags are filled to the maximum volume. FIG. 1C is a cross-section side view of the product case 10 with liquid bag 20, taken along line A-A of FIG. 1B. Dispensing fluid from the bag when it is full is reliable because there is sufficient head pressure from the liquid itself to push the liquid out through the outlet 18. However, as the liquid bag 20 drains over the course of multiple dispenses, the loose material of the bag will collapse onto the surface of the liquid.

Experiments have shown that the last 500 mL liquid in the bag 20 is problematic because the loose material of the bag 20 does not collapse repeatedly or reliably in the same direction, even though special fold lines are formed in the bag 20. As a result, the loose material of the bag can collapse onto the outlet 18 and block or impede the remaining liquid from draining, or creating folds or pockets where product can be trapped. In this situation, the user will deem the bag empty and switch it out for a full bag, resulting in non-dispensed product being thrown away.

This problem also exists in situations where a smaller liquid bag, such as a 5 L liquid bag is used in a product case configured for receiving a 10 L liquid bag. FIG. 2 shows a top view of the same 10 L product case 10, but this time having a 5 L liquid bag 22 having an outlet 24 inserted therein. In FIG. 2, the outline of the 5 L liquid bag 22 is shown assuming the bag is full. Over time as the liquid in the bag 22 is drained, the loose material of the liquid bag 22 may stretch out to the rear of the product case 10 as shown by the dashed lines 26. This is because the liquid in the bag will tend to spread out over the area of the floor of the product case 10 as constrained by the sidewalls. Not only does this affect the head pressure characteristics, the material of the liquid bag 22 also does not collapse repeatedly or reliably in the same direction even though special fold lines are formed in the bag 22. The loose material will collapse over the outlet 18 thereby preventing any remaining product from being dispensed, or the loose material will create folds or pockets where product can be trapped.

In some applications, speed of service for dispensing liquid from the bag is required. In such situations a smaller liquid bag, such as a pillow bag is positioned such that it is standing up and not lying flat on its larger surface. Unfortunately by standing the pillow bag up, it becomes inherently unstable and will likely fall over in some random direction that could also result in wasted liquid product that cannot be dispensed.

Therefore, it is desirable to provide a system that minimizes waste of liquid product in a liquid bag and provides repeatable flow characteristics.

SUMMARY

It is an object of the present disclosure to obviate or mitigate at least one disadvantage of previous liquid bag product cases.

In a first aspect, the present disclosure provides a product case for receiving a fluid bag. The product case includes a floor, sidewalls, and a bag supporter. The floor includes an opening configured to receive an outlet nozzle of the fluid bag for draining fluid from the fluid bag by gravity. The sidewalls extend from the floor to form a rectangular enclosure for the fluid bag. The bag supporter is in contact with the fluid bag. The bag supporter includes a guide notch, a slot, and a removable retaining wall. The guide notch is formed in a top edge of one sidewall of the sidewalls to facilitate receipt of material of the fluid bag. The slot in the one sidewall extends a predetermined distance from a bottom of the triangular shaped notch and is configured to receive and retain the material of the fluid bag, the triangular shaped notch and the slot being positioned on the one sidewall for minimizing bag material from covering the outlet nozzle as the fluid bag empties. The removable retaining wall is held by support structures on a pair of the sidewalls opposing each other to divide the rectangular enclosure into a smaller enclosure such that all the sidewalls and the removable retaining wall constrain the fluid bag within the smaller enclosure.

According to an embodiment of the first aspect, the slot extends from the bottom of the guide notch towards the floor and is terminated with at least one additional cut extending through a thickness of the one sidewall. The guide notch can be triangular-shaped. In this embodiment, the at least one additional cut can form an aperture, which in one example is circular in shape. The slot can be spaced with a gap to compress and frictionally retain the material of the fluid bag. Alternately, the aperture enables flexing of sidewall portions on either side of the slot, where the slot is spaced with a minimum sized gap for flexing one of the sidewall portions towards an interior of the rectangular enclosure and the other of the sidewall portions towards an exterior of the rectangular enclosure when the material of the fluid bag is inserted into the slot.

In yet a further embodiment, the at least one additional cut does not form an aperture and instead includes a pair of linear cuts extending through the thickness of the one sidewall to enable flexing of sidewall portions on either side of the slot. In this further embodiment, the slot is spaced with a minimum sized gap for flexing one of the sidewall portions towards an interior of the rectangular enclosure and the other of the sidewall portions towards an exterior of the rectangular enclosure when the material of the fluid bag is inserted into the slot.

In another embodiment of the first aspect, the support structures include grooves formed in each of the pair of the sidewalls, and each of the grooves is sized to receive a width of the removable retaining wall. Alternately, the support structures include raised structures formed on each of the pair of the sidewalls to form grooves, and each of the grooves is sized to receive a width of the removable retaining wall. In a further embodiment of the first aspect, multiple support structures are formed on the pair of the sidewalls opposing each other for receiving the removable retaining wall at different positions to divide the rectangular enclosure into any number of smaller enclosures.

In yet another embodiment of the first aspect, the removable retaining wall opposes the one sidewall, and another guide notch and slot are formed in the removable retaining wall.

According to another embodiment of the first aspect, a second sidewall opposing the one sidewall includes another guide notch and slot. In this embodiment, the guide notch and the another guide notch are a first guide notch and a second guide notch, and the slot and the another slot are a first slot and a second slot, and a third guide notch and a third slot are formed in a third sidewall perpendicular to the one sidewall.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

FIG. 5A is a top view of the novel product case showing flexing of sidewall portions, according to a present embodiment;

FIG. 5B is a top view of the novel product case showing a slot with a gap with predetermined spacing, according to a present embodiment; and FIG. 5C is a front view of an alternate embodiment of the novel product case shown in FIG. 3B.

DETAILED DESCRIPTION

Generally, the present disclosure provides a product case with a liquid bag supporter to improve the flow of liquid to the outlet of the liquid bag and thereby reduce wasted liquid product. The product case is used in gravity based fluid dispensing systems. The product case has a floor and sidewalls that form a rectangular enclosure for the fluid bag, and a bag supporter in contact with the fluid bag. The bag supporter includes a notch formed in a top edge of one sidewall to facilitate receipt of material of the fluid bag, a slot in the one sidewall extending from a bottom of the triangular shaped notch and configured to receive and retain the material of the fluid bag, and a removable retaining wall held by support structures on a pair of the sidewalls opposing each other to divide the rectangular enclosure into a smaller enclosure. The sidewalls and the removable retaining wall constrain the fluid bag within the smaller enclosure, while the triangular shaped notch and the slot minimizes fluid bag material from covering the outlet nozzle as the fluid bag empties and supports the bag for repeatable flow properties and efficient drainage.

Figure 3A:
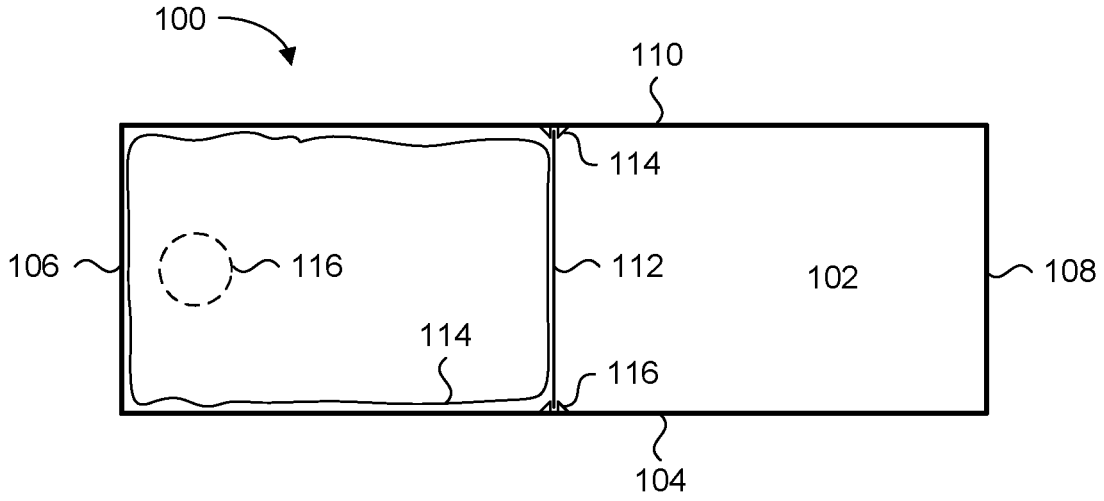
FIG. 3A is a top view of a novel product case according to a present embodiment.
Figure 3B:
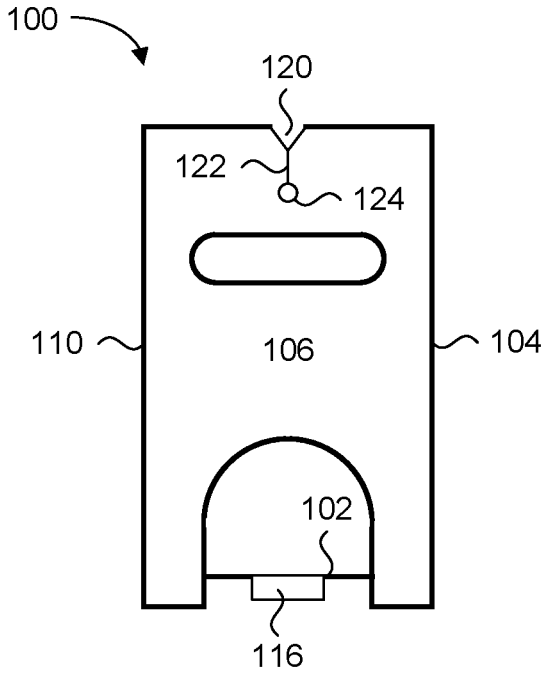
FIG. 3B is a front view of the novel product case of FIG. 3A according to a present embodiment.

FIG. 3A and FIG. 3B show an embodiment of a novel product case according to a present embodiment. FIG. 3 *a* shows a top down view of the product case while FIG. 3B shows a front end view of the same novel product case. The novel product case has an open top as with the prior art product case shown in FIG. 1B, which facilitates the insertion and removal of a fluid bag therein by a user.

As shown in FIG. 3A, and FIG. 3B the product case 100 has a floor 102 and four sidewalls 104, 106, 108 and 110 that extend from the floor 102 and form a rectangular enclosure. For the purposes of comparison, product case 100 has the same dimensions as the product case shown in FIG. 1B. The height of the sidewalls 104, 106, 108 and 110 are the same, and are intended to retain a fluid bag therein. According to a present embodiment, the product case 100 includes a bag supporter that includes at least one of the following support features.

One bag support feature is the removable retaining wall 112 that is held in place by support structures 114 and 116 on a pair of the sidewalls opposing each other, such as sidewalls 104 and 110. The removable retaining wall is configured to be rigid and resistant to bending under force. In the particular embodiment of FIG. 3A, support structures 114 and 116 are raised structures formed on sidewalls 104 and 110 to form grooves, and each of the grooves is sized to receive a width of the removable retaining wall 112. In use, the removable retaining wall 112 is simply slid into the grooves and the bottom of the removable retaining wall 112 rests on the floor 102. In an alternate embodiment, the support structures 114 and 116 are grooves formed within the surface of sidewalls 104 and 110. Similarly, these grooves are sized to receive a width of the removable retaining wall 112.

Figure 1B:
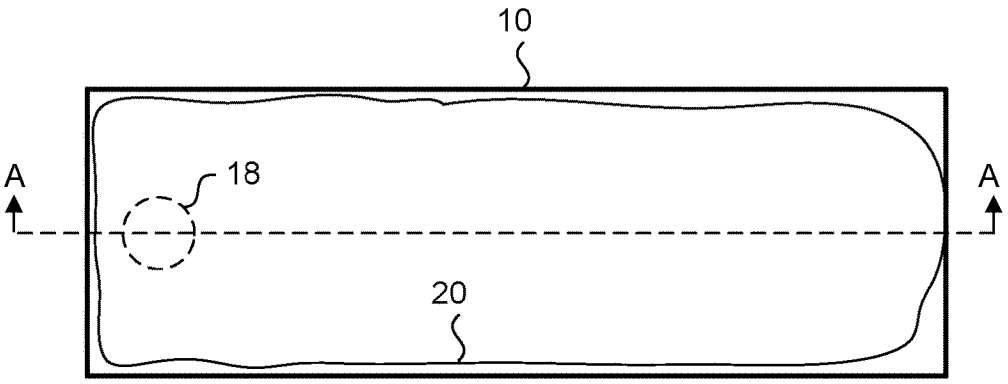
FIG. 1B is a top view of the product case of FIG. 1A.
Figure 1C:
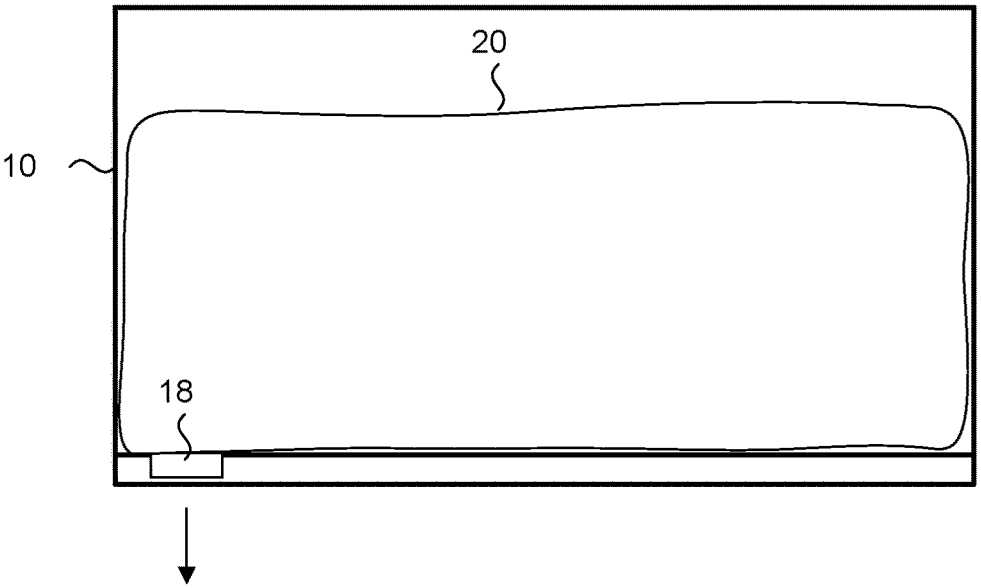
FIG. 1C is a cross-section side view of the product case of FIG. 1B.
Figure 1A:
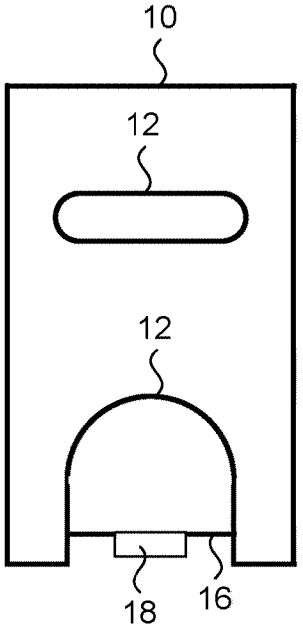
FIG. 1A is a front end view of a product case of the prior art.
Figure 2:
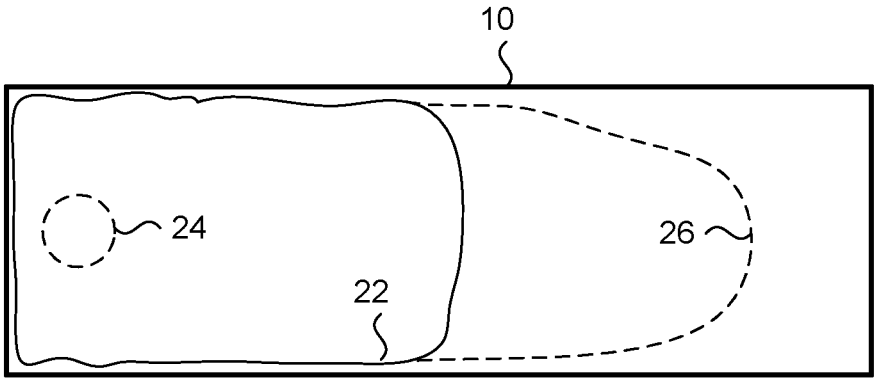
FIG. 2 is a top view of the product case of FIG. 1A with a smaller liquid bag.

In this particular example, although the product case 100 has a maximum rectangular size to receive a large liquid bag such as liquid bag 20 of FIG. 1B, a small liquid bag 114 such as liquid bag 22 of FIG. 2 is shown inserted in the product case 100. Because the removable retaining wall 112 has been inserted, as the liquid bag 114 drains, the portion of the liquid bag 114 with remaining liquid is supported and constrained by sidewalls 104, 106, 110 and 112. This type of support facilitates the drainage of liquid in liquid bag 114 by gravity through the bag outlet 116 (shown in dashed lines) as repeatable head pressure is provided for a greater number of dispenses relative to the example situation of FIG. 2. In FIG. 2, as the liquid drains, the remaining liquid and bag material spreads out and takes on the shape of the floor of the rectangular enclosure, thereby reducing available head pressure.

The present embodiment of FIG. 3A shows support structures 114 and 116 formed at a position to accommodate a 5 L liquid bag 114. However, alternate embodiments can have multiple sets of support structures formed along the sidewalls 104 and 110 to support and constrain liquid bags of different volumes.

Another bag support feature is best shown in FIG. 3B, by the guide notch 120, slot 122 and an optional additional cut 124. These features are combined together to receive and retain material of a liquid bag inserted into product case 100. In this particular embodiment of FIG. 3B, the guide notch 120 is triangular-shaped, slot 122 is cut through the entire thickness of sidewall 106, and the additional cut 124 is also cut through the entire thickness of sidewall 106 to create a circular aperture. The additional cut is optional since the slot 122 can have sufficient retaining strength for holding the material of the liquid bag as liquid drains out and tends to fall under its own weight.

The purpose of the guide notch 120 is to facilitate entry of material of the liquid bag into the slot 122, at which point the material is gripped and retained. While the guide notch 120 is triangular-shaped in the embodiment of FIG. 3B, where two edges of the triangle start at a top edge of sidewall 106 and end at a corner or vertex. The slot 122 begins at this vertex and vertically extends towards the floor 102. In this particular embodiment the circular aperture helps retain additional material of the liquid bag and prevents it from moving up towards the guide notch 120 and slipping out.

In alternate embodiments, the guide notch 120 can have just one edge angled from the top edge of sidewall 106 while the other edge is 90° to the top edge of sidewall 106, and both edges end at the beginning of slot 122. In a further alternate embodiment, the guide notch 120 is not triangular in shape and can have one or two curved edges beginning at the top edge of sidewall 106 and ending at the beginning of slot 122. The guide notch 120 can have any shape that facilitates entry of the liquid bag material into the slot 122.

In the present embodiments, slot 122 is shown to extend vertically relative to the top edge of sidewall 106. In alternate embodiments, slot 122 can extend at an angle relative to the top edge of sidewall 106, and the same desired effect of retaining the material of the liquid bag is achieved.

Figure 4A:
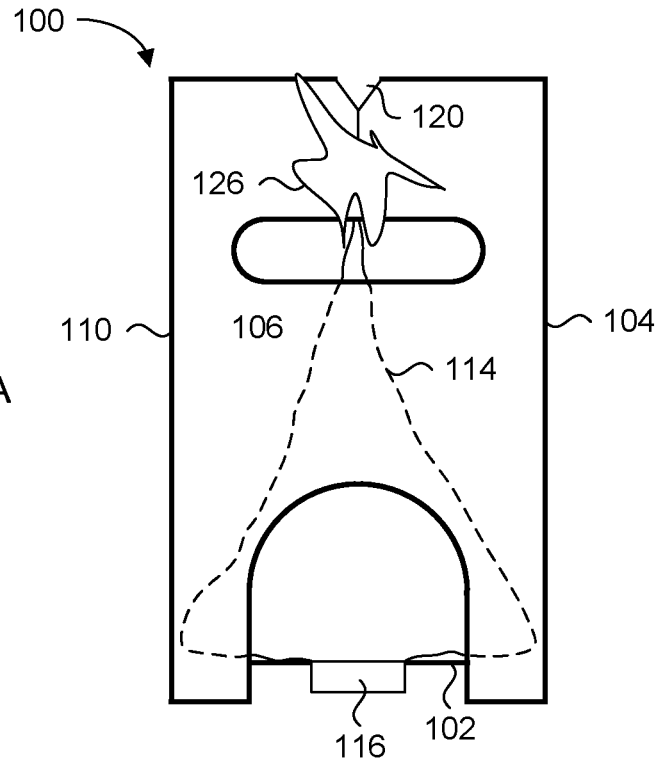
FIG. 4A is the front view of the novel product case of FIG. 3A with an installed fluid bag according to a present embodiment.
Figure 4B:
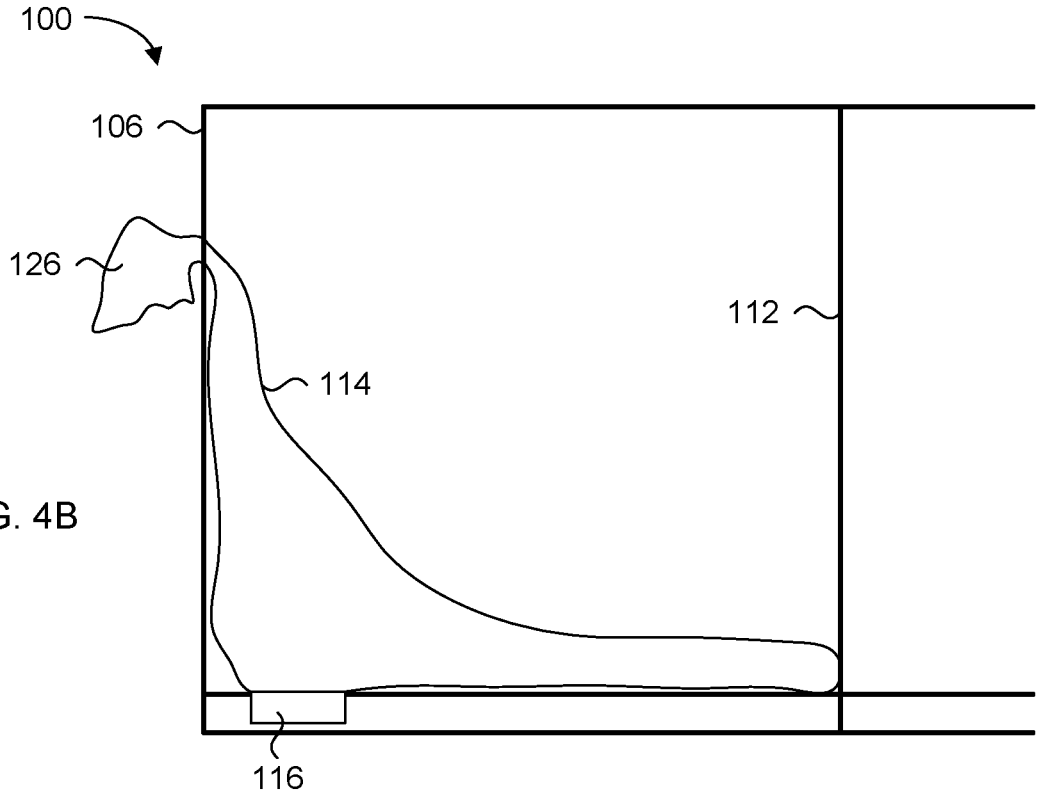
FIG. 4B is a side view of the novel product case shown in FIG. 4A according to a present embodiment.

FIG. 4A and FIG. 4B show examples of product case 100 in use with a liquid bag. FIG. 4A shows a front view of product case 100 while FIG. 4B shows a side view of the product case 100 with the side wall 104 removed to illustrate the shape of the liquid bag 114. It is assumed that the liquid bag 114 was previously installed into product case 100 as a full bag, and the removable retaining wall 112 has been installed. Even when full, the liquid bag 114 has extra material at the corners thereof which can be gripped by a user and wedged into the slot 122 and to the circular aperture 124 via guide notch 120. This extra material is shown with reference number 126 and hangs outside of the sidewall 106.

As fluid drains through outlet 116 after repeated dispenses, the liquid in liquid bag 114 drops. The sidewalls 104, 106, 110 and the removable retaining wall 112 constrain the bag material of the remaining liquid and thereby help maintain repeatable head pressure. As shown in FIG. 4B, the bag material will fall onto the surface of the remaining liquid. However, because the extra material 126 of the liquid bag 114 is held in the slot 122 and circular aperture 124, it is clearly seen that this portion of the bag material does not fall substantively onto the surface of the remaining liquid. More specifically, it can be seen from FIG. 4B that any extra material of the liquid bag 114 is restricted from falling over the outlet 116, thereby preventing blockage of the outlet 116 that prevents remaining liquid in the liquid bag 114 from draining through outlet 116.

Therefore, the bag supporter features of product case 100 enables the maximum amount of liquid in liquid bag 114 to repeatably drain through outlet 116.

The guide notch 120, slot 122 and an additional cut 124 in the embodiment of FIGS. 4A and 4B are formed in the side wall 106 as it is the closest to the outlet 116. This minimizes the amount of material of the liquid bag from collapsing onto outlet 116. In alternative embodiments, if the outlet 116 is positioned closer to either sidewall 104 or 110, then the guide notch 120, slot 122 and an additional cut 124 can be formed in those sidewalls instead. In a further alternative embodiment, an additional guide notch, slot and additional cut can be formed in the removable retaining wall 112 for smaller liquid bags and in the rear side wall 108 for larger liquid bags.

Figure 4C:
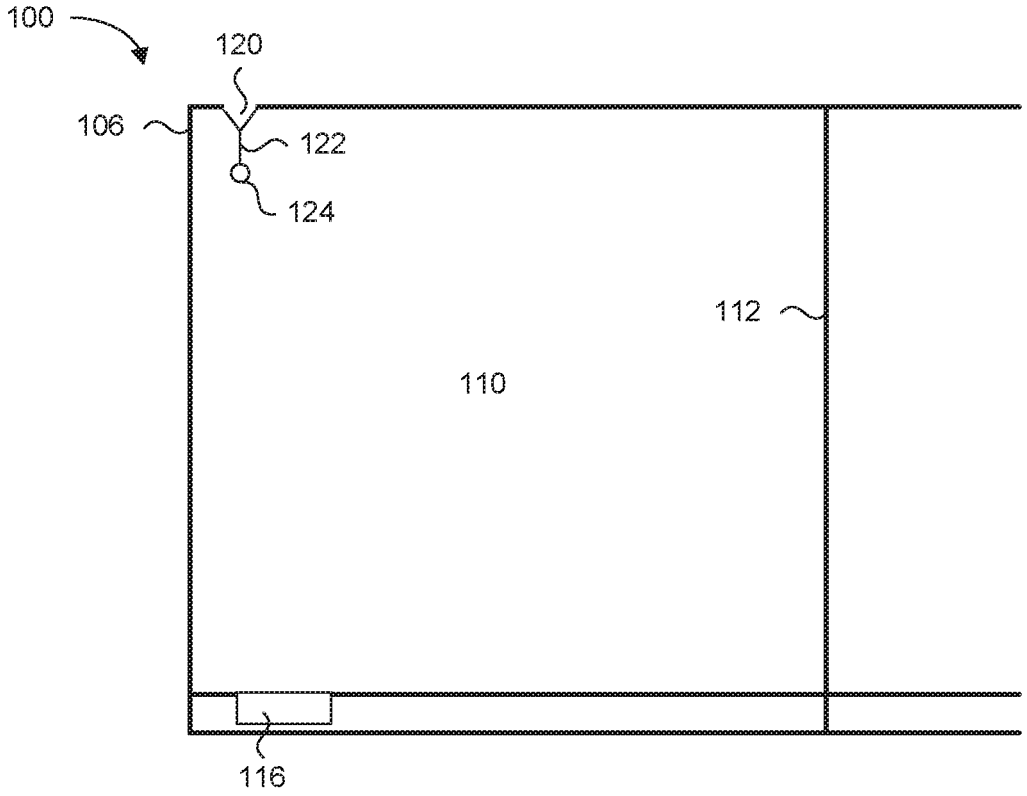
FIG. 4C is a side view of the novel product case shown in FIG. 4A according to an alternate embodiment.

FIG. 4C is an alternate embodiment of the product case shown in FIGS. 3A and 3B. FIG. 4C shows a side view of the product case 100 with the side wall 104 removed and without an installed liquid bag to clearly show sidewall 110. In this alternate embodiment, sidewall 110 includes the previously shown bag support feature consisting of a guide notch 120, slot 122 and additional cut 124. While not shown because sidewall 104 has been removed, another bag support feature consisting of a guide notch, slot and additional cut are formed in sidewall 104. Therefore, the bag support feature formed in sidewall 104 and in sidewall 110 oppose each other and are generally spaced from sidewall 106 by the same distance. In some situations, both of these bag support features are used simultaneously when holding the 2 front corners of a liquid bag. These bag support features provide the same advantages as previously described for the embodiments shown in FIGS. 3A, 3B, 4A and 4B.

Therefore, in a further alternate embodiment, the product case shown in FIG. 4C can have a third guide notch with slot and additional cut formed in sidewall 106, which is perpendicular to sidewalls 104 and 110. This allows for additional flexibility to accommodate different liquid bags of different sizes and configurations.

A further discussion of the slot 122 and additional cut 124 embodiments now follows with reference to FIG. 5A, FIG. 5B and FIG. 5C. It has been previously described that the slot 122 is configured to grip or retain extra material of the liquid bag in order to prevent material of the liquid bag from falling over its outlet as the liquid level drops. The additional cut 124 has been shown as a circular aperture, but could also be any type of shaped aperture that is not circular, as long as it prevents the extra material from sliding up through the slot 122.

A first possible configuration of slot 122 is shown in FIG. 5A, which shows a partial top view of the product case 100. In this first configuration, the slot 122 is formed to have a predetermined width "g" between its edges in sidewall 106 that form the slot 122. The width "g" is selected to compress a bunched collection of loose material of the liquid bag there between, such that the elastic force of the bunched material pushes against the edges of slot 122. Therefore a sufficient frictional force is provided to prevent the material wedged into slot 122 from sliding up or down or in and out. It is assumed in such a case that the thickness and material of sidewall 106 is of sufficient rigidity to limit bending or deflection of the portions of the side wall 106 adjacent slot 122.

A second possible configuration of slot 122 is shown in FIG. 5B, which shows a partial top view of the product case 100. In this second configuration, the slot 122 is formed to have a minimum width between its edges in sidewall 106 that form the slot 122. In conjunction with the additional cut, which in one embodiment is a circular aperture, two flaps 130 and 132 are formed. If the material of sidewall 106 is resilient, the flaps 130 and 132 can flex or bend in the directions of the arrows shown when a user pushes extra material of the liquid bag into the slot 122. Because the flaps 130 and 132 are naturally biased to return to their straight configuration to be in line with the rest of the top edge of sidewall 106, they will pinch the extra material to prevent it from sliding up or down or in and out of the slot 122.

In an alternate embodiment, the additional cut 124 can include further linear cuts 140 that start at the end of the slot 122 and each extend away from the slot 122. The linear cuts 140 can be parallel with the top edge of sidewall 106, or they can be angled as shown in FIG. 5C. The direction and length of the linear cuts 140 should be designed to provide the necessary flexibility for flaps 130 and 132. For example, when taking into account the material and thickness of sidewall 106, longer linear cuts 140 will provide higher flexibility while shorter linear cuts 140 provide lower flexibility of the flaps 130 and 132, but provide stronger pinching of material of the liquid bag.

These alternate configurations of the slot and additional cut can be applied to any of the previously shown embodiments of the product case which can have multiple guide notches, slots and additional cuts.

In the previously shown embodiments, the guide notch, slot and additional cut are generally centered about the outlet of the liquid bag. However, slight variations are possible where the guide notch, slot and additional cut are offset to the left or right of the outlet of the liquid bag. Such configurations will also retain the material of the liquid bag in an elevated position and prevent extra material from falling onto the outlet.

When used in combination with each other, the bag supporter of the product case shown in the embodiments improves accuracy of dispenses from the top of the liquid bag to the bottom, and bag evacuation is dramatically improved. Consistency to the end user in beverage profile or taste is provided, and cost savings to the restaurant or convenience store is realized through waste reduction.

In the preceding description, for purposes of explanation, numerous details are set forth in order to provide a thorough understanding of the embodiments. However, it will be apparent to one skilled in the art that these specific details are not required. In other instances, well-known electrical structures and circuits are shown in block diagram form in order not to obscure the understanding.

The above-described embodiments are intended to be examples only. Alterations, modifications and variations can be effected to the particular embodiments by those of skill in the art. The scope of the claims should not be limited by the particular embodiments set forth herein, but should be construed in a manner consistent with the specification as a whole.

The invention claimed is:

1. A product case for receiving a fluid bag, comprising:

a floor having an opening configured to receive an outlet nozzle of the fluid bag for draining fluid from the fluid bag by gravity;

sidewalls extending from the floor to form a rectangular enclosure for the fluid bag; and a bag supporter in contact with the fluid bag, the bag supporter including, a guide notch formed in a top edge of one sidewall of the sidewalls to facilitate receipt of material of the fluid bag, a slot in the one sidewall extending a predetermined distance from a bottom of the guide notch and configured to receive and retain the material of the fluid bag, the guide notch and the slot being positioned on the one sidewall for minimizing bag material from covering the outlet nozzle as the fluid bag empties, and a removable retaining wall held by support structures on a pair of the sidewalls opposing each other to divide the rectangular enclosure into a smaller enclosure such that all the sidewalls and the removable retaining wall constrain the fluid bag within the smaller enclosure.

2. The product case of claim 1, wherein the slot extends from the bottom of the guide notch towards the floor and is terminated with at least one additional cut extending through a thickness of the one sidewall.

3. The product case of claim 2, wherein the at least one additional cut forms an aperture.

4. The product case of claim 3, wherein the slot is spaced with a gap to compress and frictionally retain the material of the fluid bag.

5. The product case of claim 3, wherein the aperture is circular in shape.

6. The product case of claim 3, wherein the aperture enables flexing of sidewall portions on either side of the slot.

7. The product case of claim 6, wherein the slot is spaced with a minimum sized gap for flexing one of the sidewall portions towards an interior of the rectangular enclosure and the other of the sidewall portions towards an exterior of the rectangular enclosure when the material of the fluid bag is inserted into the slot.

8. The product case of claim 2, wherein the at least one additional cut includes a pair of linear cuts extending through the thickness of the one sidewall to enable flexing of sidewall portions on either side of the slot.

9. The product case of claim 8, wherein the slot is spaced with a minimum sized gap for flexing one of the sidewall portions towards an interior of the rectangular enclosure and the other of the sidewall portions towards an exterior of the rectangular enclosure when the material of the fluid bag is inserted into the slot.

10. The product case of claim 1, wherein the support structures include grooves formed in each of the pair of the sidewalls, and each of the grooves is sized to receive a width of the removable retaining wall.

11. The product case of claim 1, wherein the support structures include raised structures formed on each of the pair of the sidewalls to form grooves, and each of the grooves is sized to receive a width of the removable retaining wall.

12. The product case of claim 1, wherein multiple support structures are formed on the pair of the sidewalls opposing each other for receiving the removable retaining wall at different positions to divide the rectangular enclosure into any number of smaller enclosures.

13. The product case of claim 1, wherein the removable retaining wall opposes the one sidewall.

14. The product case of claim 13, further including another guide notch and slot formed in the removable retaining wall.

15. The product case of claim 1, wherein a second sidewall opposing the one sidewall includes another guide notch and slot.

16. The product case of claim 15, wherein the guide notch and the another guide notch are a first guide notch and a second guide notch, and the slot and the another slot are a first slot and a second slot, and a third guide notch and a third slot are formed in a third sidewall perpendicular to the one sidewall.

17. The product case of claim 1, wherein the guide notch is triangular-shaped.

* * * * *